US010912692B2

(12) United States Patent
Kim

(10) Patent No.: US 10,912,692 B2
(45) Date of Patent: Feb. 9, 2021

(54) STANDING-UP ASSISTANCE METHOD AND APPARATUS

(71) Applicant: Samsung Electronics Co., Ltd., Suwon-si (KR)

(72) Inventor: Kyung-Rock Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 803 days.

(21) Appl. No.: 15/083,456

(22) Filed: Mar. 29, 2016

(65) Prior Publication Data

US 2017/0128291 A1 May 11, 2017

(30) Foreign Application Priority Data

Nov. 9, 2015 (KR) ..... 10-2015-0156615

(51) Int. Cl.

*A61G 5/14* (2006.01)
*A61H 1/02* (2006.01)
*A61H 3/00* (2006.01)

(52) U.S. Cl.

CPC ..... *A61G 5/14* (2013.01); *A61H 1/0244* (2013.01); *A61H 3/00* (2013.01); *A61H 2201/1207* (2013.01); *A61H 2201/163* (2013.01); *A61H 2201/164* (2013.01); *A61H 2201/165* (2013.01); *A61H 2201/1628* (2013.01); *A61H 2201/1642* (2013.01); *A61H 2201/5007* (2013.01); *A61H 2201/5058* (2013.01);

(Continued)

(58) Field of Classification Search

CPC ..... A61H 1/024; A61H 1/0244; A61H 3/00; A61H 2201/5071; A61H 2201/1207; A61H 2201/163; A61H 2201/1642; A61H 2201/5007; A61H 2201/164; A61H 2201/1628; A61H 2201/165; A61H 2201/5061; A61H 2201/5058; A61H 2201/5069

USPC ..... 601/5, 34

See application file for complete search history.

(56) References Cited

U.S. PATENT DOCUMENTS 5,980,435 A * 11/1999 Joutras ..... A43B 1/0054 482/114
2003/0093021 A1* 5/2003 Goffer ..... A61F 5/0102 602/23

(Continued)

FOREIGN PATENT DOCUMENTS

CN 103037827 A 4/2013
JP H08 19577 A 1/1996

(Continued)

OTHER PUBLICATIONS

Book of Body Language, Jun. 7, 2007, West Side ToastMasters, https://westsidetoastmasters.com/resources/book_of_body_language/chap11.html (Year: 2007).*

(Continued)

*Primary Examiner* — Tu A Vo
*Assistant Examiner* — Alexander Morales
(74) *Attorney, Agent, or Firm* — Harness, Dickey and Pierce, P.L.C.

(57) ABSTRACT

A standing-up assistance method and apparatus may measure a pressure applied to a part of a body of a user, acquire information about a torque corresponding to the measured pressure, and provide an assistance force to the body of the user based on the information about the torque.

28 Claims, 15 Drawing Sheets

(52) U.S. Cl.
CPC ..... *A61H 2201/5061* (2013.01); *A61H 2201/5069* (2013.01); *A61H 2201/5071* (2013.01)

(56) References Cited

U.S. PATENT DOCUMENTS

| | | | | |
|---|---|---|---|---|
| 2004/0158175 | A1* | 8/2004 | Ikeuchi | A61H 3/008 601/5 |
| 2004/0212177 | A1 | 10/2004 | Kuiken | |
| 2006/0258967 | A1* | 11/2006 | Fujil | A61F 5/0102 602/23 |
| 2006/0270951 | A1* | 11/2006 | Ikeuchi | A61H 3/00 601/5 |
| 2007/0054777 | A1* | 3/2007 | Kawai | A61H 3/00 482/1 |
| 2007/0191743 | A1* | 8/2007 | McBean | A61B 5/04888 601/5 |
| 2008/0242521 | A1 | 10/2008 | Einav | |
| 2012/0071797 | A1* | 3/2012 | Aoki | A61H 1/024 601/34 |
| 2013/0012852 | A1* | 1/2013 | Imaida | A61F 5/01 602/16 |
| 2014/0100492 | A1* | 4/2014 | Nagasaka | A61H 3/061 601/34 |
| 2014/0142475 | A1* | 5/2014 | Goldfarb | A61H 3/00 601/35 |
| 2015/0088269 | A1 | 3/2015 | Roh | |
| 2015/0190923 | A1 | 7/2015 | Seo et al. | |
| 2015/0366739 | A1* | 12/2015 | Endo | A61H 3/00 482/4 |

FOREIGN PATENT DOCUMENTS

| | | | |
|---|---|---|---|
| JP | 2006-204485 | A | 8/2006 |
| JP | 08019577 | A * | 1/2008 |
| JP | 2012-187385 | A | 10/2012 |
| JP | 2014068869 | A | 4/2014 |
| JP | 2015-050837 | A | 3/2015 |
| JP | 2015-080621 | A | 4/2015 |
| KR | 100651638 | B1 | 11/2006 |
| KR | 100975557 | B1 | 8/2010 |
| KR | 10-2013-0093415 | | 8/2013 |
| KR | 10-2014-0078492 | | 6/2014 |
| WO | WO-2015/115491 | A1 | 8/2015 |

OTHER PUBLICATIONS

Extended European Search Report issued by the European Patent Office dated Nov. 3, 2016 for corresponding EP Patent Application No. 16170162.8.

Office Action issued by the European Patent Office dated Nov. 27, 2018 for the corresponding EP Patent Application No. 16170162.8.

Chinese Office Action dated Nov. 8, 2019 for CN Application No. 201610528149.6.

Freedom of Motion, "Walking Assist Device with Stride Management Assistt", For those with weakened leg muscles who are still able to walk, HONDA, The Power of Dreams, walkassist.honda.com.

Yoon Hyuk Kim et al., "Estimation of Joint Moment and Muscle Force in Lower Extremity During Sit-to-Stand Movement by Inverse Dynamics Analysis and by Electromyography", ISSN 1226-4873, The Korean Society of Mechanical Engineers, 2010, pp. 1345-1350.

Atsushi Tsukahara et al., "Sit-to-Stand and Stand-to-Sit Transfer Support for Complete Paraplegic Patients with Robot Suit HAL", Advanced Robotics, 24, 2010, pp. 1615-1638.

Freedom of Motion, "Walking Assist Device with Bodyweight Support Assist", For activities requiring extended standing or repetitive lower-body tasks, HONDA, The Power of Dreams, walkassist.honda.com.

Japanese Office Action dated Oct. 13, 2020 for Japanese Application No. 2016-154405.

Extended European Search Report issued by the EPO dated Nov. 25, 2020 for the corresponding European Application No. 20186737.1.

* cited by examiner

STANDING-UP ASSISTANCE METHOD AND APPARATUS

CROSS-REFERENCE TO RELATED APPLICATION

This application claims under 35 U.S.C. § 119 to Korean Patent Application No. 10-2015-0156615, filed on Nov. 9, 2015, in the Korean Intellectual Property Office, the entire contents of which are incorporated herein by reference in its entirety.

BACKGROUND

1. Field

At least one example embodiment relates to a method and/or apparatus for assisting a standing-up motion. For example, at least some example embodiments relate to a method and/or apparatus for providing an assistance force for a standing-up motion based on a pressure applied to a body part.

2. Description of the Related Art

With the onset of rapidly aging societies, many people may experience inconvenience and/or pain from joint problems. Thus, there may be growing interest in muscular strength assistance devices that may enable the elderly and/or patients having joint problems to walk and stand up with less effort. Furthermore, muscular strength assistance devices for intensifying muscular strength of human bodies may be useful for military purposes.

SUMMARY

Some example embodiments relate to a standing-up assistance method.

In some example embodiments, the method includes measuring a pressure applied to a part of a body of a user; acquiring torque information corresponding to the measured pressure; and generating an assistance force to apply to the body of the user based on the torque information.

In some example embodiments, the measuring includes measuring the pressure applied to a knee of the user.

In some example embodiments, the pressure is applied to the knee by a hand of the user.

In some example embodiments, the method further includes determining a moving state of the user, wherein the acquiring acquires the torque information, if determining determines that the moving state is a sit-to-stand state.

In some example embodiments, the determining a moving state comprises: measuring at least one joint angle of the user; and determining the moving state based on the at least one joint angle.

In some example embodiments, the at least one joint angle includes one or more of a left hip joint angle and a right hip joint angle of the user.

In some example embodiments, the at least one joint angle includes one or more of a left knee joint angle and a right knee joint angle of the user.

In some example embodiments, the at least one joint angle includes one or more of a left ankle joint angle and a right ankle joint angle of the user.

In some example embodiments, the determining of the moving state includes sensing an upper body movement associated with movement of an upper part of the body of the user; and determining the moving state based on the upper body movement.

In some example embodiments, the sensing includes sensing the upper body movement using an inertial measurement unit (IMU).

In some example embodiments, the determining of the moving state includes measuring at least one joint angle of the user; sensing an upper body movement associated with movement of an upper part of the body of the user; estimating rotation information of one or more legs of the user based on the at least one joint angle and the upper body movement; and determining the moving state based on the rotation information.

In some example embodiments, the determining the moving state includes determining which of a plurality of moving states corresponds to the estimated rotation information.

In some example embodiments, the plurality of moving states includes at least a standing state, a sitting state, a sit-to-stand state and a stand-to-sit state.

In some example embodiments, the determining the moving state includes determining which of a plurality of moving states corresponds to the at least one joint angle of the user.

In some example embodiments, the method further includes storing a torque pattern associated with the torque information; and generating a sit-to-stand pattern of the user based on the torque pattern.

In some example embodiments, the method further includes determining a moving state of the user, wherein the generating the assistance force, generates the assistance force if the determining determines that the moving state is a sit-to-stand state, and the generating the assistance force includes, setting second torque information corresponding to the sit-to-stand pattern, when the sit-to-stand pattern is generated; and generating the assistance force based on the second torque information.

In some example embodiments, the generating a sit-to-stand pattern includes adjusting the sit-to-stand pattern based on one or more additional torque patterns associated with the sit-to-stand pattern.

Some example embodiments relate to standing-up assistance apparatus.

In some example embodiments, the apparatus includes a pressure sensor configured to measure a pressure applied to a part of a body of a user; a processor configured to acquire torque information corresponding to the measured pressure; and a driver configured to generate an assistance force to the body of the user based on the torque information.

In some example embodiments, the pressure sensor is configured to measure a pressure applied to a knee of the user.

In some example embodiments, the processor is configured to, determine a moving state of the user, and acquire the torque information, if the processor determines that the moving state is a sit-to-stand state.

In some example embodiments, the apparatus further includes an inertial measurement unit (IMU) configured to sense an upper body movement associated with movement of an upper part of the body of the user, wherein the processor is configured to determine the moving state based on the upper body movement.

In some example embodiments, the apparatus further includes at least one joint angle sensor configured to measure at least one joint angle of the user; and an inertial measurement unit (IMU) configured to sense an upper body movement associated with movement of an upper part of the body of the user, wherein the processor is configured to, estimate rotation information of one or more legs of the user based on the at least one joint angle and the upper body movement, and determine the moving state based on the rotation information.

In some example embodiments, the apparatus further includes a memory configured to store a torque pattern associated with the torque information, wherein the processor is configured to generate a sit-to-stand pattern of the user based on the torque pattern.

In some example embodiments, the processor is configured to, determine the moving state of the user, set second information corresponding to the sit-to-stand pattern, if the moving state is a sit-to-stand state and the sit-to-stand pattern is generated, and instruct the driver to generate the assistance force to the body of the user based on the second torque information.

Some example embodiments relate to a method of generating an assistance force to assist a user to stand-up using an assistance device.

In some example embodiments, the method includes determining if a moving state of the user is a sit-to-stand state; acquiring torque information associating with standing, if the moving state is the sit-to-stand state; generating the assistance force based on the torque information.

In some example embodiments, the determining includes calculating rotation information associated with rotation of one or more legs of the user.

In some example embodiments, the calculating includes measuring one or more of a joint angle of a joint of a lower body of the user and motion of an upper body of the user.

In some example embodiments, the measuring includes measuring one or more of an angular velocity and acceleration of the upper body of the user.

In some example embodiments, the method further includes measuring pressure applied to one or more of the knees of the user, wherein the acquiring torque information includes setting the torque information based on the measured pressure such that a magnitude of the torque information is proportional to the measured pressure.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
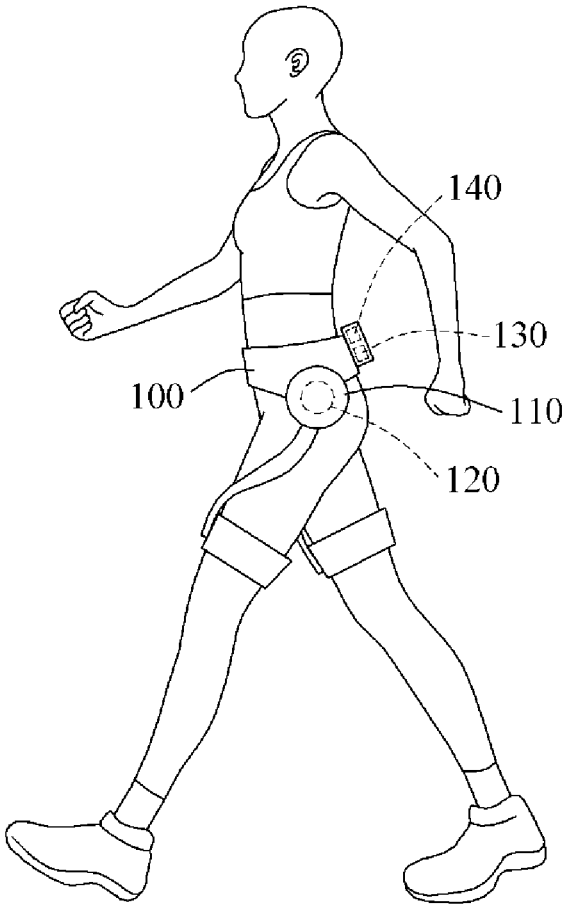
FIGS. 1 and 2 illustrate a walking assistance apparatus according to at least one example embodiment.

Hereinafter, some example embodiments will be described in detail with reference to the accompanying drawings. The scope of the patent application, however, should not be construed as limited to the embodiments set forth herein. Like reference numerals in the drawings refer to like elements throughout the present disclosure.

Various modifications may be made to the example embodiments. However, it should be understood that these embodiments are not construed as limited to the illustrated forms and include all changes, equivalents or alternatives within the idea and the technical scope of this disclosure.

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "include" and/or "have," when used in this specification, specify the presence of stated features, integers, steps, operations, elements, components or combinations thereof, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which these example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as one computer processing device; however, one skilled in the art will appreciate that a hardware device may include multiple processing elements and multiple types of processing elements. For example, a hardware device may include multiple processors or a processor and a controller. In addition, other processing configurations are possible, such as parallel processors.

Various example embodiments will now be described more fully with reference to the accompanying drawings in which some example embodiments are shown. In the drawings, the thicknesses of layers and regions are exaggerated for clarity.

<Summary of Walking Assistance Apparatus>

Figure 2:
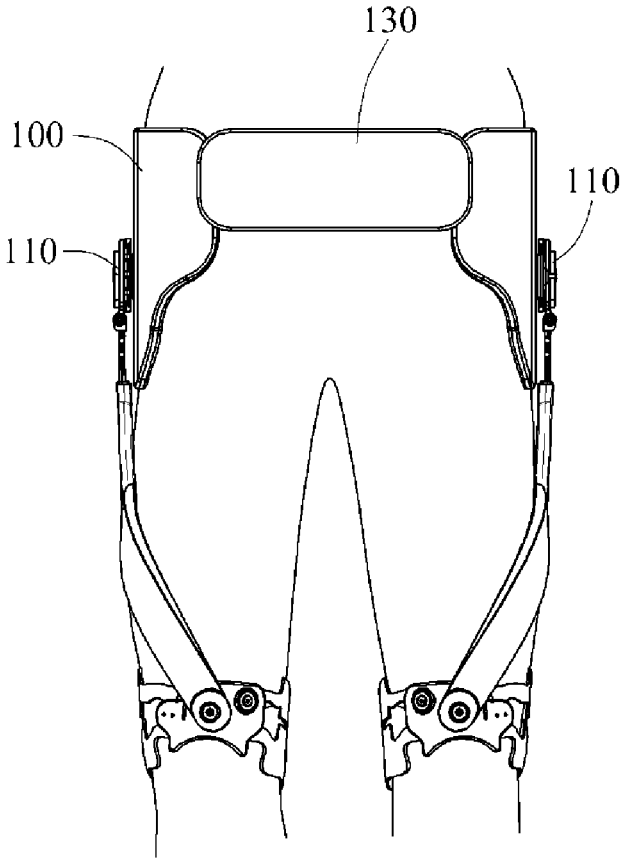

FIGS. 1 and 2 illustrate a walking assistance apparatus according to at least one example embodiment.

Referring to FIG. 1, a walking assistance apparatus 100 may be a wearable device worn on a user and that assists walking of a user. FIG. 1 illustrates an example of a hip-type walking assistance apparatus, however, a type of walking assistance apparatuses is not limited to the hip-type walking assistance apparatus. Accordingly, the walking assistance apparatus 100 may be, for example, one of a walking assistance apparatus for supporting a portion of a pelvic limb, a walking assistance apparatus for supporting up to a knee, and a walking assistance apparatus for supporting up to an ankle, and a walking assistance apparatus for supporting an entire pelvic limb.

Referring to FIGS. 1 and 2, the walking assistance apparatus 100 may include a driving portion 110, a sensor 120, an inertial measurement unit (IMU) sensor 130, and a controller 140.

The driving portion 110 may drive hip joints of a user. The driving portion 110 may be located on, for example, a right hip portion and/or a left hip portion of the user. The driving portion 110 may include a motor to generate a rotational torque.

The sensor 120 may measure hip joint angles of the hip joints of the user while the user is ambulatory. Information about the hip joint angles sensed by the sensor 120 may include, for example, an angle of a right hip joint, an angle of a left hip joint, a difference between both the hip joint angles, and/or a direction of motion for a hip joint. The sensor 120 may be located in, for example, the driving portion 110. The sensor 120 may include a potentiometer. The potentiometer may sense a right (R)-axis joint angle, a left (L)-axis joint angle, an R-axis joint angular velocity, and/or an L-axis joint angular velocity, based on a gait motion of the user.

The IMU sensor 130 may measure acceleration information and/or posture information while the user is ambulatory. For example, the IMU sensor 130 may sense an x-axis acceleration, a y-axis acceleration, a z-axis acceleration, an x-axis angular velocity, a y-axis angular velocity, and/or a z-axis angular velocity, based on a gait motion of the user. The walking assistance apparatus 100 may detect a point at which a foot of the user lands based on the acceleration information measured by the IMU sensor 130.

The walking assistance apparatus 100 may include, in addition to the above-described sensor 120 and IMU sensor 130, another sensor (for example, an electromyography (EMG) sensor) configured to sense a change in a bio signal and/or a quantity of motion of a user based on a gait motion.

The controller 140 may control the driving portion 110 to output an assistance force to assist walking of the user. The controller 140 may output a control signal to control the driving portion 110 to generate a torque. The driving portion 110 may generate a torque based on the control signal output from the controller 140. The torque may be set by an external device or the controller 140.

The above-described walking assistance apparatus 100 may provide an additional function of determining a moving state of the user, in addition to a function of assisting walking of the user. For example, the walking assistance apparatus 100 may provide a function of assisting a standing-up motion of the user. A method by which the walking assistance apparatus 100 assists a standing-up motion of a user will be described with reference to FIGS. 3 through 16.

In the present disclosure, the terms "standing-up" and "sit-to-stand" may be used interchangeably with respect to each other.

<Summary of Standing-Up Assistance Method>

Figure 3:
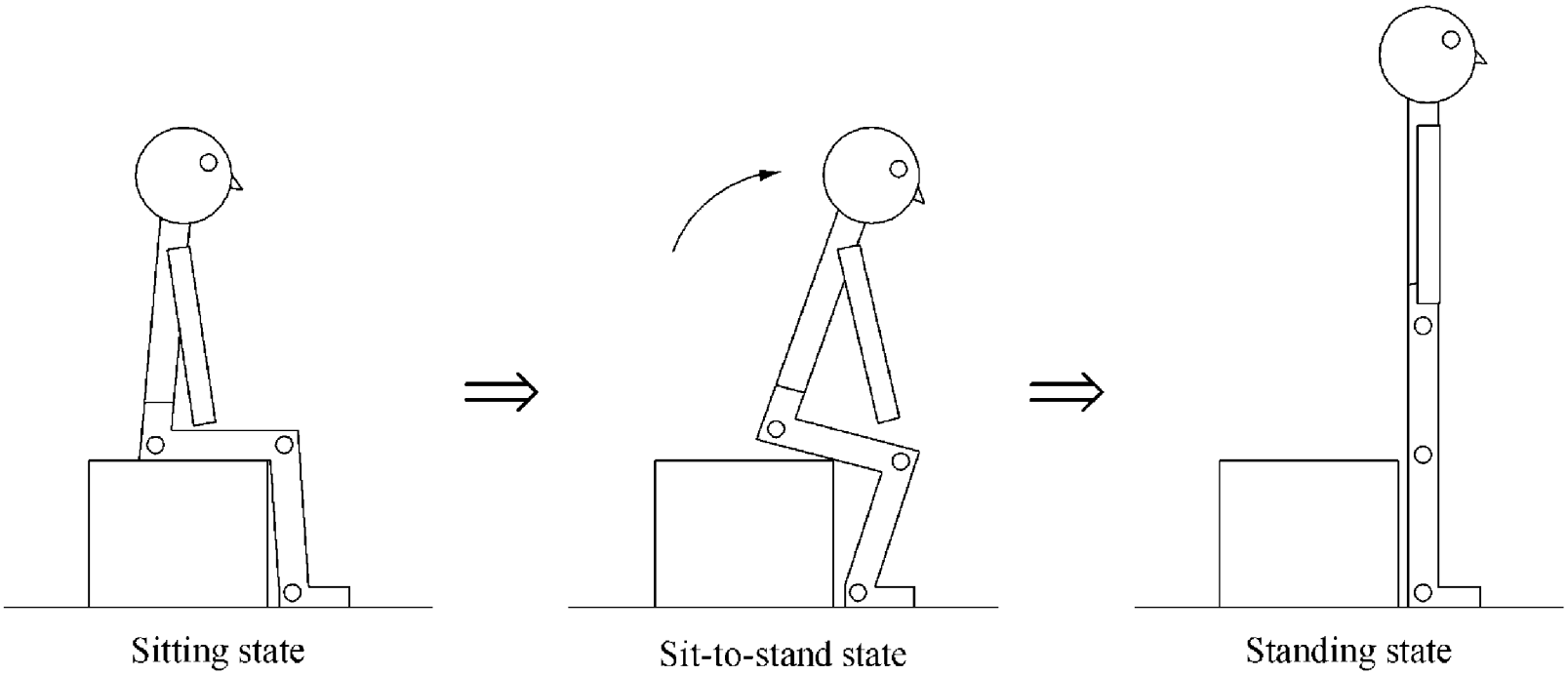
FIG. 3 illustrates a sit-to-stand motion according to at least one example embodiment.

FIG. 3 illustrates a sit-to-stand motion according to at least one example embodiment.

Referring to FIG. 3, when a person in a sitting state intends to stand up, the person may shift their center of gravity to a toe side, and stretch their back.

When performing the aforementioned motions to stand up, it may be difficult for a person with insufficient muscular strength of waist muscles to stretch their back. Therefore, arm muscles may be used as an assistance force. For example, to stand up, a person may stretch their back using a support force generated by putting their hands on their knees and straightening their arms.

In one or more example embodiments, the above mechanism may be applied to an apparatus for assisting a standing-up motion. For example, as discussed herein, when a pressure is applied to a knee of a user, the apparatus for assisting the standing-up motion may provide the user with an assistance force to assist stretching of a user's back. The user may adjust the assistance force by adjusting the pressure applied to the knee. A method of assisting a standing-up motion will be further described with reference to FIGS. 4 through 16.

Figure 4:
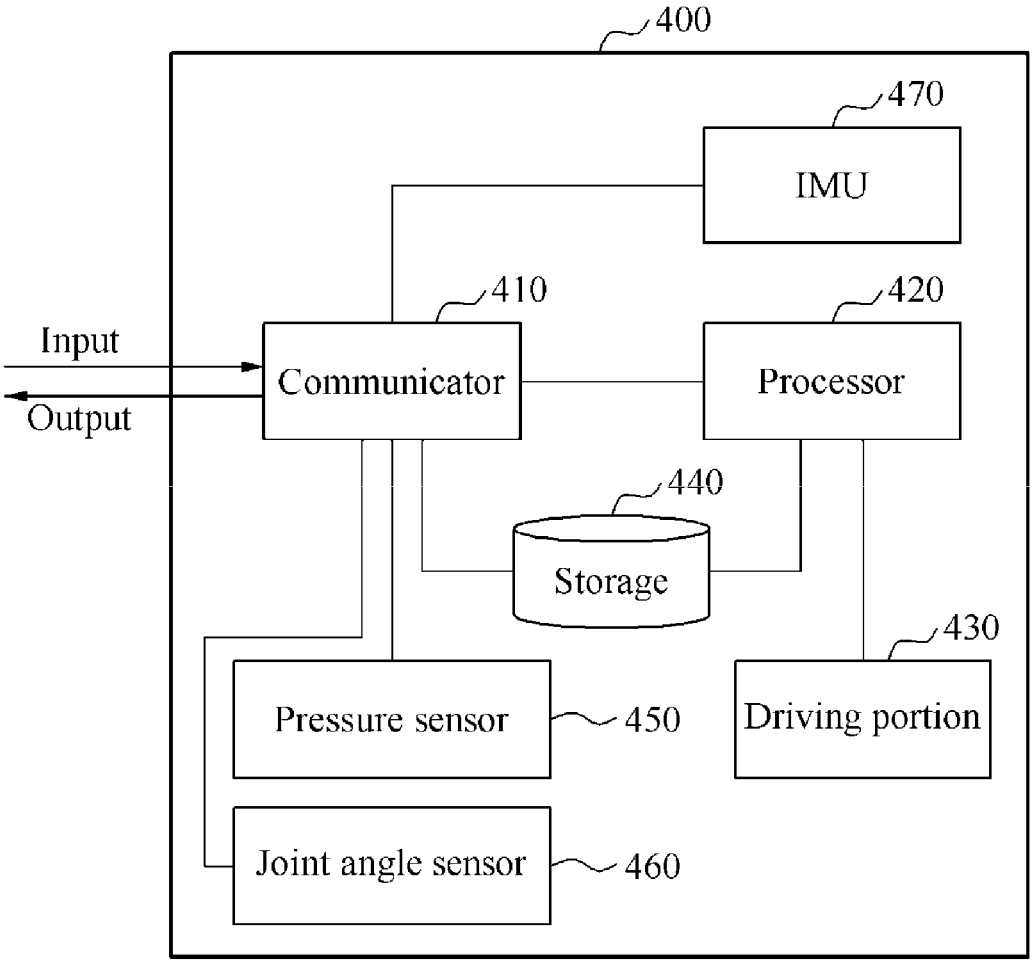
FIG. 4 illustrates a configuration of a standing-up assistance apparatus according to at least one example embodiment.

FIG. 4 illustrates a configuration of a standing-up assistance apparatus 400 according to at least one example embodiment.

The standing-up assistance apparatus 400 may be the above-described walking assistance apparatus 100, and may provide a user with an assistance force to assist walking of the user, in addition to a function of assisting a standing-up motion of a user. Also, the standing-up assistance apparatus 400 may be used as a stand-alone apparatus to output an assistance force to assist a standing-up motion of a user.

Referring to FIG. 4, the standing-up assistance apparatus 400 may include a communicator 410, a processor 420, a driving portion 430, a storage 440, a pressure sensor 450, a joint angle sensor 460, and an IMU 470.

The communicator 410 may be connected to the processor 420, the storage 440, the pressure sensor 450, the joint angle sensor 460 and the IMU 470, and may transmit and receive data. Also, the communicator 410 may be connected to an external device, and may transmit and receive data.

The processor 420 may be implemented by at least one semiconductor chip disposed on a printed circuit board. The processor 420 may be an arithmetic logic unit, a digital signal processor, a microcomputer, a field programmable array, a programmable logic unit, a microprocessor or any other device capable of responding to and executing instructions in a defined manner.

The processor 420 may process data received by the communicator 410 and data stored in the storage 440. The processor 420 may transmit information about an assistance force to the driving portion 430. The processor 420 may correspond to the above-described controller 140 of FIG. 1.

For example, the processor 420 may be programmed with instructions that configure the processor 420 into a special purpose computer to perform the operations illustrated in FIG. 5 and sub-operations associated therewith, discussed below, such that the processor 420 is configured to provide an assistance force to assist a user with performing a sit-to-stand motion such that an amount torque is proportional to an amount of pressure the user applies to their knees when performing the sit-to-stand motion.

The driving portion 430 may output the assistance force based on the information about the assistance force. The driving portion 430 may correspond to the above-described driving portion 110 of FIG. 1.

The storage 440 may be a non-volatile memory, a volatile memory, a hard disk, an optical disk, and a combination of two or more of the above-mentioned devices. The memory may be a non-transitory computer readable medium. The non-transitory computer-readable media may also be a distributed network, so that the program instructions are stored and executed in a distributed fashion. The non-volatile memory may be a Read Only Memory (ROM), a Programmable Read Only Memory (PROM), an Erasable Programmable Read Only Memory (EPROM), or a flash memory. The volatile memory may be a Random Access Memory (RAM).

The storage 440 may store data received by the communicator 410 and data processed by the processor 420.

The pressure sensor 450 may measure a pressure applied to a sensor. The pressure sensor 450 may be physically separated from the standing-up assistance apparatus 400. For example, the pressure sensor 450 may communicate with the communicator 410 using a wireless communication scheme, for example, a Bluetooth communication.

The joint angle sensor 460 may measure a joint angle of the user.

The IMU 470 may measure a change in an orientation of an object. The IMU 470 may correspond to the IMU sensor 130 of FIG. 1.

Figure 5:
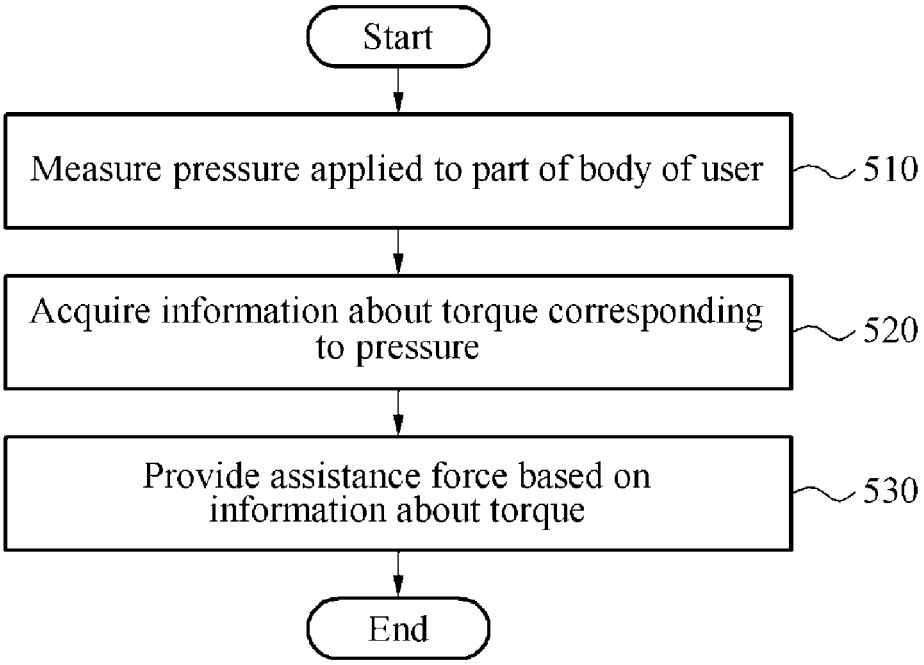
FIG. 5 is a flowchart illustrating a standing-up assistance method according to at least one example embodiment.
Figure 6:
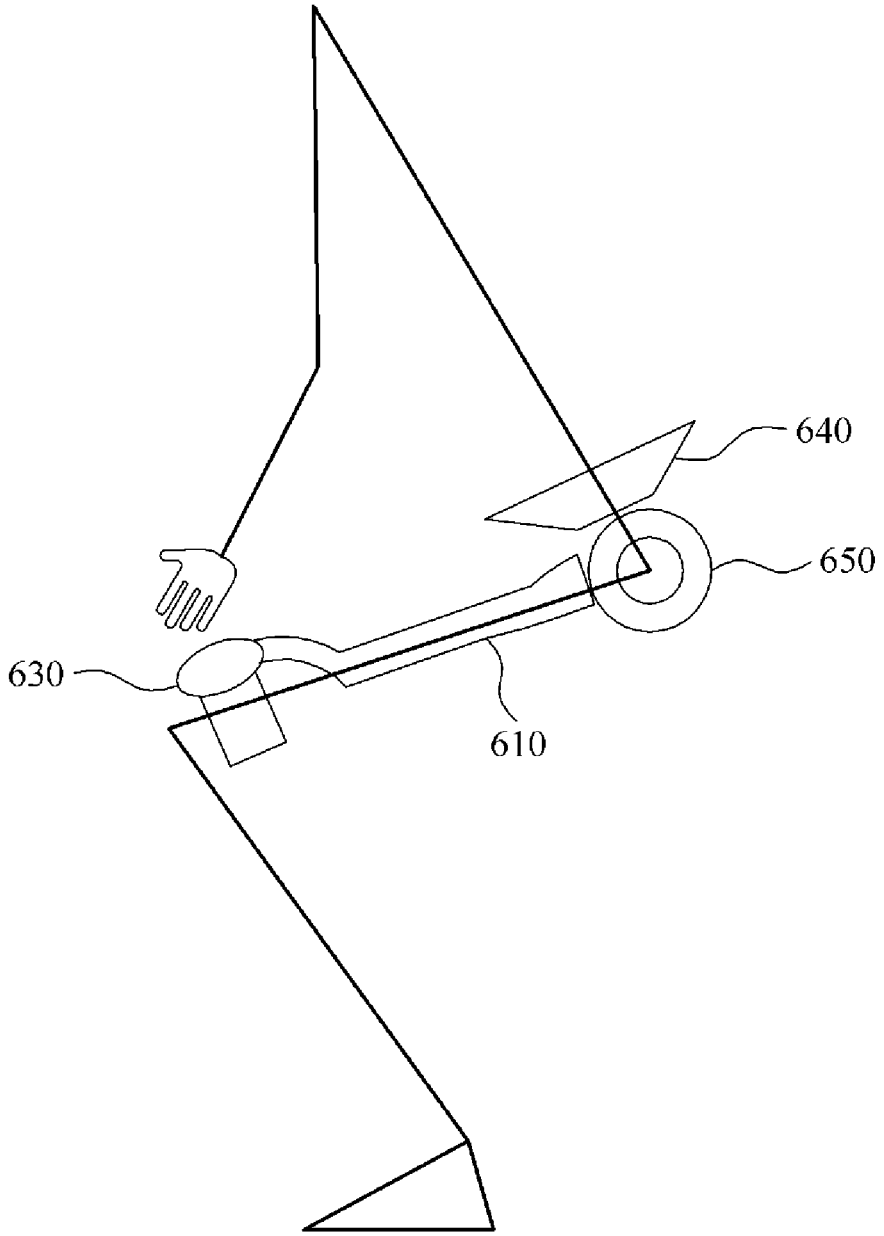
FIG. 6 illustrates an attachment location of a pressure sensor according to at least one example embodiment.

FIG. 5 is a flowchart illustrating a standing-up assistance method according to at least one example embodiment. FIG. 6 illustrates an attachment location of a pressure sensor according to at least one example embodiment.

Referring to FIGS. 5 and 6, in operation 510, the pressure sensor 450 may measure a pressure applied to a part of a body of a user. The pressure sensor 450 may be located in the part of the body, for example, a knee, a thigh or a palm of the user.

As illustrated in FIG. 6, a pressure sensor 630 of a standing-up assistance apparatus may be attached to a knee portion of a user and may measure a pressure applied to a knee using a hand of the user. However, example embodiments are not limited thereto. For example, the pressure sensor 450 may be mounted in locations other than the part of the body of the user. For example, when the pressure sensor 450 is located in a handle of a walking stick and a user applies a pressure by grabbing the handle with a hand, a magnitude of the applied pressure may be measured. The pressure sensor 450 may measure a change in pressure during a period of time the pressure is applied.

In operation 520, the processor 420 may acquire information about a torque corresponding to the measured pressure. The processor 420 may calculate a torque for assisting a standing-up motion based on a set (or, alternatively, a preset) constant. The constant may be set differently for users through a desired (or, alternatively, a predetermined) calibration process, and the calculated torque may be proportional to the measured pressure.

In operation 530, the driving portion 430 may provide an assistance force to the body of the user based on the information about the torque. For example, the driving portion 430 may output a calculated torque using a motor to provide the assistance force. The driving portion 430 may be, for example, a motor located in a hip joint of the user, and may provide the assistance force, to widen a space between a waist and legs of the user.

As illustrated in FIG. 6, a driving portion 650 may correspond to the driving portion 430 and may output a torque, to widen a space between a waist support 640 and a thigh wearing portion 610 of the standing-up assistance apparatus 400.

Figure 7:
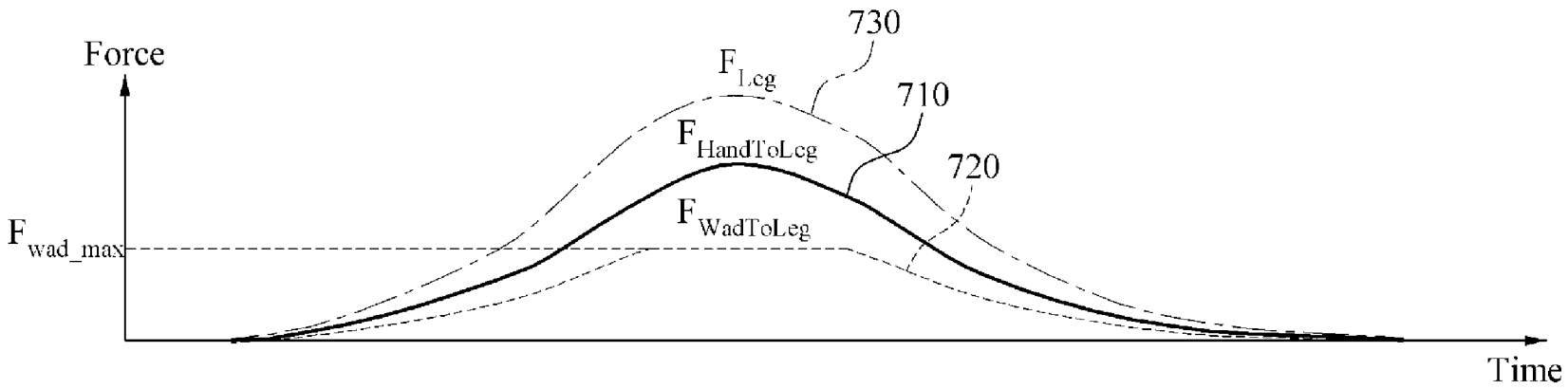
FIG. 7 illustrates a provided assistance force according to at least one example embodiment.

FIG. 7 illustrates a provided assistance force according to at least one example embodiment.

Referring to FIG. 7, in a first curve 710, a pressure measured by a pressure sensor is represented as a force. In a second curve 720, a torque output by a driving portion is represented as a force. A third graph 730 shows a force exerted on a leg.

In FIG. 7, a y-axis represents a magnitude of a force. The y-axis may be understood as a magnitude of a force corresponding to a magnitude of a torque, or as a magnitude of a force corresponding to a magnitude of a pressure.

The torque provided by the standing-up assistance apparatus 400 may be calculated using Equation 1 shown below.

$$F_{WadToLeg}=k*F_{HandToLeg} \quad \text{[Equation 1]}$$

In Equation 1, $F_{WadToLeg}$ denotes a value of a torque to be output by the standing-up assistance apparatus 400, k denotes a set (or, alternatively, a preset) constant, and $F_{HandToLeg}$ denotes a measured pressure. Based on Equation 1, $F_{WadToLeg}$ is proportional to $F_{HandToLeg}$. When a value of the calculated torque exceeds a preset value $F_{wad_max}$, the torque may have the present value $F_{wad_max}$.

The force exerted on the leg may be calculated using Equation 2 shown below.

$$F_{Leg}=F_{WadToLeg}+F_{HandToLeg}$$

$$F_{Leg}=(1+k)*F_{HandToLeg} \quad \text{[Equation 2]}$$

Referring to Equation 2, an assistance force $F_{Leg}$ provided to a user may be a sum of the pressure $F_{HandToLeg}$ applied to a knee by the user and the torque $F_{WadToLeg}$ provided by the standing-up assistance apparatus 400.

Figure 8:
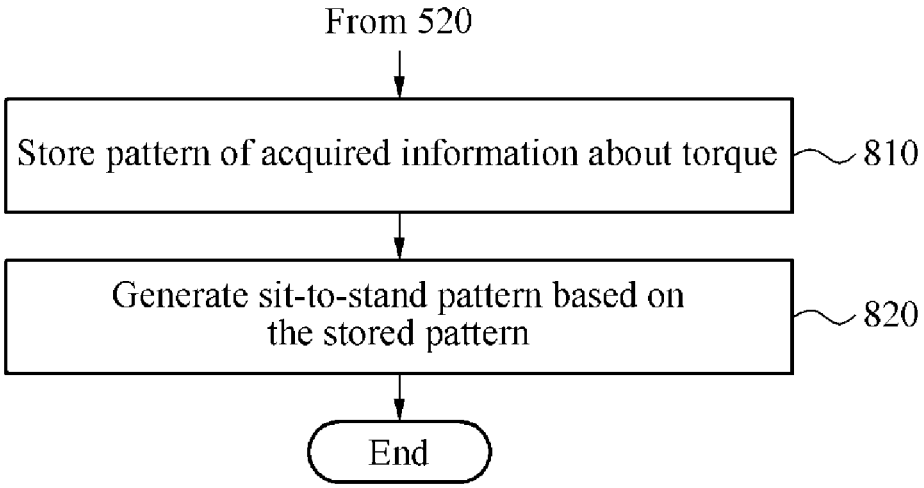
FIG. 8 is a flowchart illustrating a process of generating a sit-to-stand pattern according to at least one example embodiment.

FIG. 8 is a flowchart illustrating a process of generating a sit-to-stand pattern according to at least one example embodiment.

The standing-up assistance method of FIG. 5 may further include operations 810 and 820 of FIG. 8. Operations 810 and 820 may be performed in parallel to the above-described operation 530 of FIG. 5.

The sit-to-stand pattern may be generated based on a standing-up assistance torque calculated in advance or output by the standing-up assistance apparatus 400. For example, when the standing-up assistance torque is provided to a user five times in total through the standing-up assistance apparatus 400, the standing-up assistance apparatus 400 may analyze five standing-up assistance torques that are calculated or output, and may generate a sit-to-stand pattern of the user. The standing-up assistance apparatus 400 may output the standing-up assistance torque using the sit-to-stand pattern, based on an operating mode selected by the user, even when a pressure applied to a body of the user is not measured.

In operation 810, the processor 420 may store a pattern of the information about the torque acquired in operation 520 in the storage 440. For example, the processor 420 may store a torque pattern representing a change in a calculated torque over time. The processor 420 may store a torque pattern every time a torque is acquired, or may store a torque pattern up to a desired (or, alternatively, a predetermined) number of times (for example, five times).

In operation 820, the processor 420 may generate a sit-to-stand pattern based on stored torque patterns. In some example embodiments, the processor 420 may generate a sit-to-stand pattern to minimize errors with respect to the torque patterns. In other example embodiments, the processor 420 may determine, based on the torque patterns, a maximum torque, an increasing slope of a torque and a decreasing slope of a torque, and may generate a sit-to-stand pattern based on the determined maximum torque, the determined increasing slope and the determined decreasing slope.

When the sit-to-stand pattern is generated, additional torque patterns may be stored in the storage 440. When the additional torque patterns are stored, the processor 420 may adjust the sit-to-stand pattern to reflect characteristics of the additional torque patterns. For example, the processor 420 may adjust a sit-to-stand pattern based on the torque patterns and the additional torque patterns.

The sit-to-stand pattern may be used to provide, in operation 530, an assistance force to a user when the standing-up assistance apparatus 400 determines a moving state of the user as a sit-to-stand state even when a pressure is not measured. A method of determining the moving state will be further described with reference to FIGS. 11 through 16.

Figure 9:
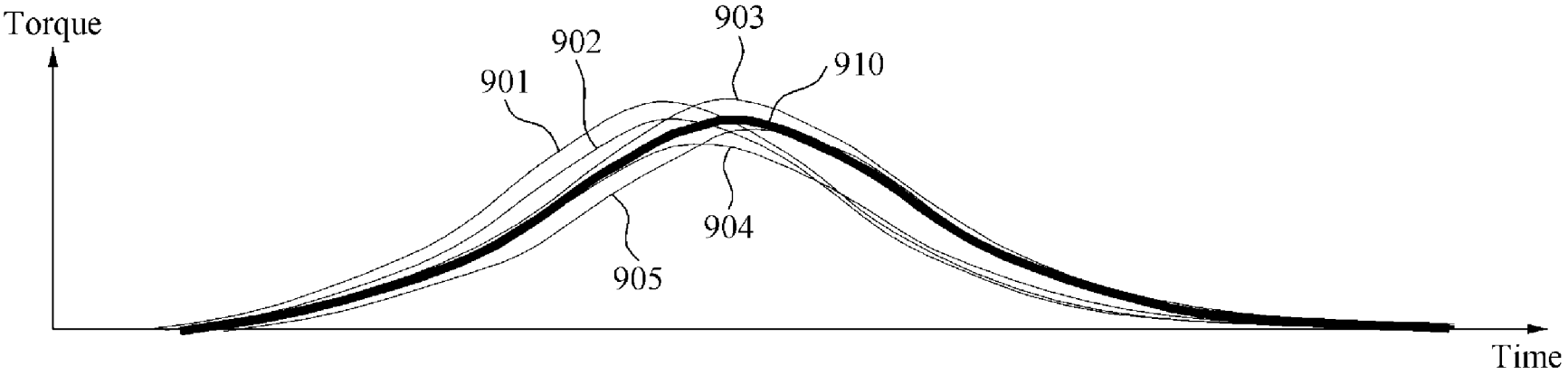
FIG. 9 illustrates an example of a generated sit-to-stand pattern according to at least one example embodiment.

FIG. 9 illustrates an example of a generated sit-to-stand pattern according to at least one example embodiment.

Referring to FIG. 9, the processor 420 may acquire torque patterns 901, 902, 903, 904 and 905. The torque patterns 901 through 905 may represent a change in a torque calculated during a period of time in which a pressure is measured.

The processor 420 may generate a sit-to-stand pattern 910 that is representative of the torque patterns 901 through 905.

For example, in some example embodiments, the processor 420 may calculate an average duration of the torque patterns 901 through 905, and may calculate an average torque of each time. In this example, the processor 420 may generate the sit-to-stand pattern 910 based on the calculated average duration and the calculated average torque. In another example embodiment, the processor 420 may generate the sit-to-stand pattern 910 to minimize an error with respect to the torque patterns 901 through 905.

Figure 10:
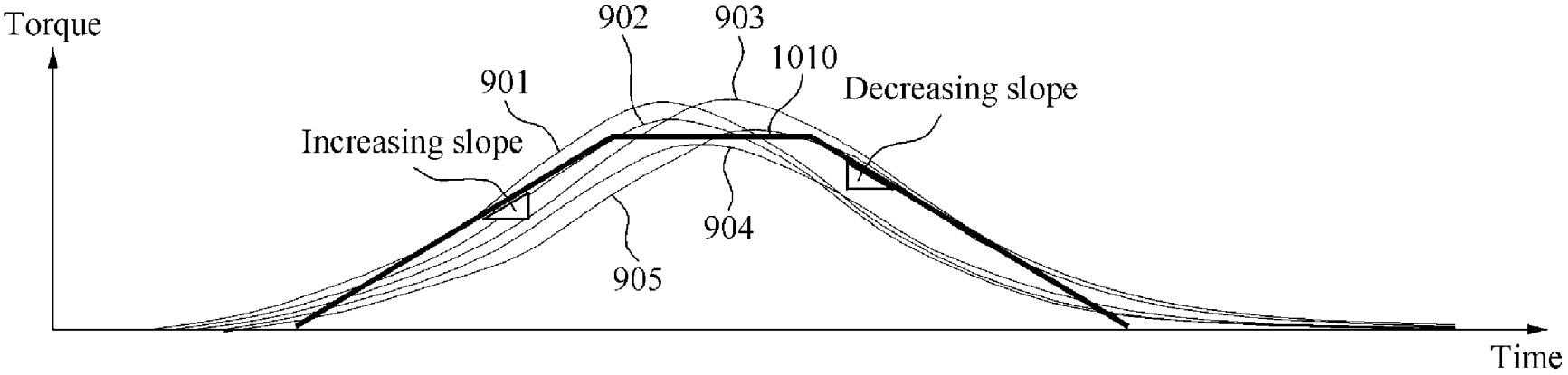
FIG. 10 illustrates another example of a generated sit-to-stand pattern according to at least one example embodiment.

FIG. 10 illustrates another example of a generated sit-to-stand pattern according to at least one example embodiment.

The processor 420 may determine a maximum torque, a maintenance period of the maximum torque, an increasing slope of a torque and a decreasing slope of a torque, based on torque patterns 901, 902, 903, 904 and 905. The processor 420 may generate a sit-to-stand pattern 1010 based on the determined maximum torque, the determined increasing slope and the determined decreasing slope.

The processor 420 may analyze characteristics of the torque patterns 901 through 905. For example, the processor 420 may calculate a rate of increase in a torque, a maximum torque, a maintenance period of the maximum torque, and a rate of decrease in a torque. The processor 420 may determine the increasing slope based on the rate of increase in the torque, and may determine the decreasing slope based on the rate of decrease in the torque. The processor 420 may generate the sit-to-stand pattern 1010 based on the maximum torque, the maintenance period of the maximum torque, the increasing slope and the decreasing slope.

Figure 11:
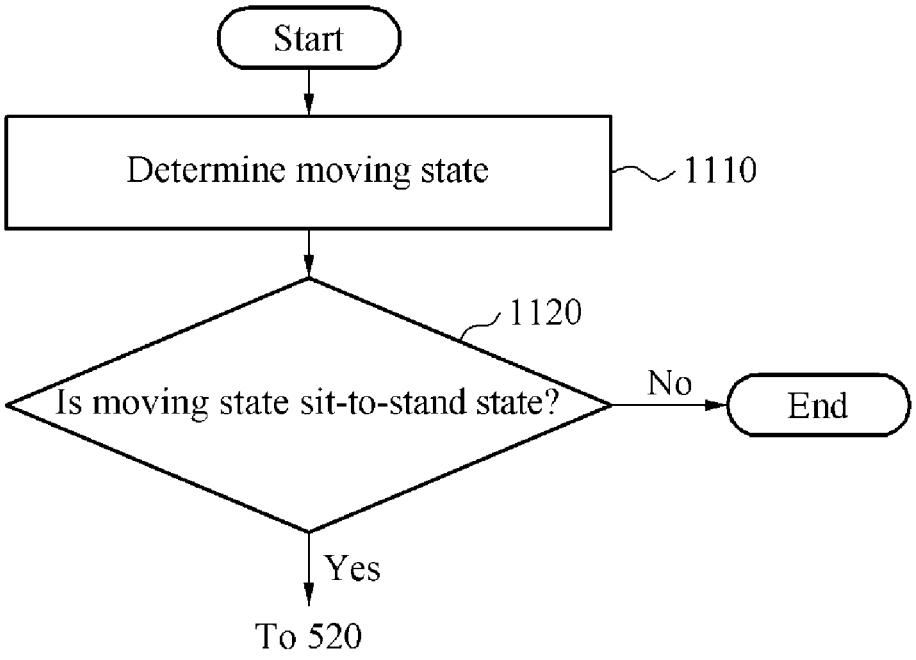
FIG. 11 is a flowchart illustrating a method of determining whether a moving state is a sit-to-stand state according to at least one example embodiment.

FIG. 11 is a flowchart illustrating a method of determining whether a moving state is a sit-to-stand state according to at least one example embodiment.

Operations 1110 and 1120 of FIG. 11 may be performed in parallel with the above-described operation 510 of FIG. 5.

In operation 1110, the processor 420 may determine a moving state of a user or an operating state of the standing-up assistance apparatus 400. Because a movement of the user is reflected on the operating state of the standing-up assistance apparatus 400, the moving state of the user may be understood to be the same as the operating state of the standing-up assistance apparatus 400.

The storage 440 may store a plurality of moving states. The processor 420 may determine which one of the plurality of moving states corresponds to a current motion, based on measured values. For example, the processor 420 may determine the moving state using a finite state machine (FSM). A process of determining the moving state of the user will be further described with reference to FIG. 12.

In operation 1120, the processor 420 may determine whether the determined moving state is a sit-to-stand state.

When the moving state is determined as the sit-to-stand state, the processor may perform the above-described operation 520 of FIG. 5.

When the moving state is not the sit-to-stand state, even when a pressure is measured, the processor may not perform operation 520. For example, when the moving state is determined not to be the sit-to-stand state, the standing-up assistance apparatus 400 may terminate the method of FIG. 11. Alternatively, when the standing-up assistance apparatus 400 has a function (for example, a walking assistance function) other than a standing-up assistance function, the standing-up assistance apparatus 400 may calculate an assistance force corresponding to the determined moving state, and may output the calculated assistance force. For example, when the moving state is determined as a walking state, the processor 420 may calculate an assistance force corresponding to a gait cycle in the walking state.

In another example, when the moving state is determined to be the sit-to-stand state in operation 1120 and when a sit-to-stand pattern generated as described above is stored in the storage 440, even when operation 510 is not performed, operation 520 may be performed. In this example, the processor 420 may acquire torque information based on the sit-to-stand pattern in operation 520.

Figure 12:
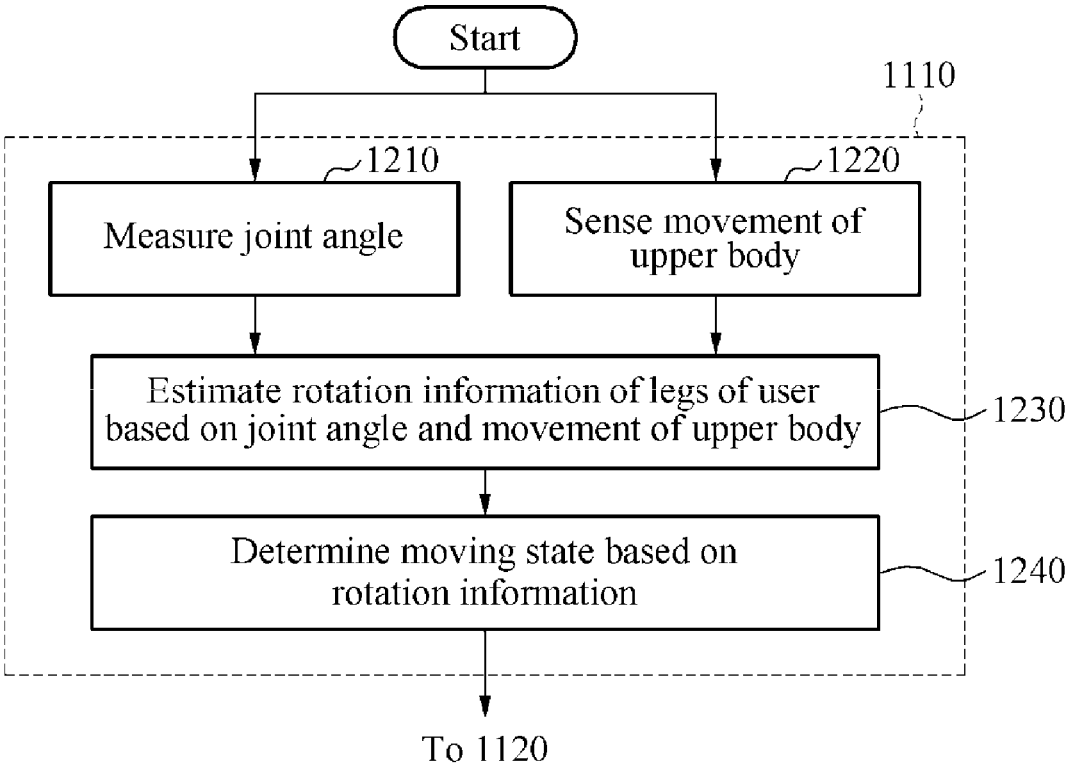
FIG. 12 is a flowchart illustrating a process of determining a moving state of a user according to at least one example embodiment.

FIG. 12 is a flowchart illustrating a process of determining a moving state of a user according to at least one example embodiment.

The above-described operation 1110 of FIG. 11 may include operations 1210, 1220, 1230 and 1240 of FIG. 12.

In operation 1210, the joint angle sensor 460 may measure information about joints of the user. The information about the joints may include a joint angle, a joint angular velocity, and/or a joint angular acceleration. The joints may include, for example, hip joints, knee joints and/or ankle joints. The joint angle sensor 460 may include an encoder configured to measure a joint angle and to calculate a joint angular velocity and a joint angular acceleration based on the measured joint angle.

In operation 1220, the IMU 470 may sense a movement of an upper body of the user. For example, the IMU 470 may sense a change in an angle about three axes, may calculate a change in an angular velocity and a change in an angular acceleration based on the sensed change in the angle, and may sense the movement of the upper body.

In operation 1230, the processor 420 may estimate rotation information of legs of the user based on the joint angle and the movement of the upper body. The rotation information may be used to determine a moving state of the user, and may be estimated based on the information about the joints instead of being directly sensed using sensors. For example, the rotation information may be calculated based on a hip joint angle and an angle of an upper body. The rotation information may include a rotational angle, a rotational angular velocity and/or a rotational angular acceleration. The rotation information may further include a right leg sit angle and a left leg sit angle to determine the moving state of the user. A rotational angle of a leg may be an angle of a leg about the direction of gravity. The rotational angle of the leg may be calculated using Equation 3 shown below.

$$C=180°-(A+B) \quad \text{[Equation 3]}$$

In Equation 3, A denotes the hip joint angle (for example, a hip joint angle 1320 of FIG. 13, discussed below), B denotes the angle of the upper body (for example, an upper body angle 1310 of FIG. 13), and C denotes the rotational angle of the leg.

As described above, when it is difficult to directly sense data used to determine a moving state of a user, the standing-up assistance apparatus 400 may acquire the data based on sensible data. Thus, it is possible to simplify a configuration of the standing-up assistance apparatus 400, and to determine a moving state of a user regardless of a type of the standing-up assistance apparatus 400.

In operation 1240, the processor 420 may determine the moving state of the user based on the rotation information. The processor 420 may compare the acquired rotation information to a set (or, alternatively, a preset) threshold, to map the rotation information to digitalized context information to determine a motion event. The motion event may refer to a movement of a leg, and the moving state of the user may be determined based on a determined motion event.

By comparing detailed information of the rotation information to the threshold, the rotation information may be mapped to digitized context information corresponding to the detailed information, as shown in Table 1 below.

TABLE 1

| | x | e | x < −e | −e ≤ x ≤ e | e < x |
|---|---|---|---|---|---|
| LA | lq | 5° | −1 | 0 | 1 |
| RA | rq | 5° | −1 | 0 | 1 |
| LSA | lq | 45° | −1 | 0 | 1 |
| RSA | rq | 45° | −1 | 0 | 1 |
| DA | lq-rq | 15° | −1 | 0 | 1 |
| LW | lw | 2°/s | −1 | 0 | 1 |
| RW | rw | 2°/s | −1 | 0 | 1 |

In Table 1, LA and RA denote context information corresponding to a left leg rotational angle, and context information corresponding to a right leg rotational angle, respectively. LSA and RSA denote context information corresponding to a left leg sit angle, and context information corresponding to a right leg sit angle, respectively. DA denotes context information corresponding to a difference between the left leg rotational angle and the right leg rotational angle. LW and RW denote context information corresponding to a left leg rotational angular velocity, and context information corresponding to a right leg rotational angular velocity, respectively.

Additionally, x refers to a variable that is compared to the threshold for the given context information. lq and rq denote the left leg rotational angle, and the right leg rotational angle, respectively, and lq-rq denotes the difference between the left leg rotational angle and the right leg rotational angle. lw and rw denote the left leg rotational angular velocity and the right leg rotational angular velocity, respectively.

The context information LA and LSA may have the same variable, that is, lq, and the context information RA and RSA may have the same variable, that is, rq, because the context information LSA and RSA are introduced to distinguish an extension event from a flexion event among motion events of the user, instead of being directly sensed. The extension event and the flexion event may correspond to a stop state.

Accordingly, the context information LSA and RSA may be used to distinguish motion events, by using the same variable for the context information LA and LSA and the same variable for the context information RA and RSA, and by setting different thresholds.

Furthermore, e denotes the threshold for each of the right leg rotational angle and left leg rotational angle. The threshold e may be used to filter out a small movement that is not intended by a user, because data is sensed due to the small movement. However, the threshold e of Table 1 is merely an example for understanding of description, and there is no limitation thereto. Accordingly, the threshold e may be set suitably for a characteristic of a user.

The processor 420 may map the detailed information of the rotation information to context information by comparing the detailed information to a preset threshold.

For example, when the left leg rotational angle lq corresponding to the context information LA is greater than an e=5° threshold, the context information LA may be mapped to "1." In another example, when the left leg rotational angle lq is less than −5°, that is, a negative value of the threshold, the context information LA may be mapped to "4." In still another example, when the left leg rotational angle lq is equal to or greater than −5° and is equal to or less than 5°, the context information LA may be mapped to "0."

The processor 420 may map each of right leg rotation information and left leg rotation information to context information by comparing each of the right leg rotation information and the left leg rotation information to the threshold e. The mapped context information may be used to determine a motion event. The motion event may be a change in a movement of a leg of a user estimated based on information sensed to determine the moving state of the user. In other words, a current moving state of the user may be determined based on the motion event and a previous moving state of the user, rather than the motion event being recognized as a final moving state of the user. In an example, when a swing event occurs in a standing state, that is, the previous moving state of the user, the current moving state of the user may be determined as a walking state. In another example, when a swing event occurs in a sitting state, that is, the previous moving state, the current moving state may also be determined as the sitting state.

Moving states of the user may be consecutive states, and accordingly the current moving state may be determined differently based on the previous moving state despite an occurrence of the same motion events. The motion event may be, for example, rotation information of legs of the user used to determine the current moving state.

The processor 420 may generate a motion event corresponding to the context information mapped based on a preset criterion. The processor 420 may determine whether a combination of the mapped context information corresponds to a predetermined motion event based on the preset criterion, and may generate a motion event corresponding to the combination of the context information.

The processor 420 may verify a duration of the motion event. For example, when the duration is equal to or longer than a preset period of time, the motion event may be lastly generated.

By verifying the duration of the motion event, the processor 420 may filter out noise of sensed data or an unintended movement of the user. Also, by verifying the duration of the motion event, it is possible to prevent a movement from being unnecessarily and/or frequently sensed, and thus it is possible to achieve reliable results.

The processor 420 may determine the current moving state of the user based on the generated motion event and the previous moving state of the user. The current moving state may be determined differently based on the previous moving state, despite an occurrence of the same motion events, and accordingly a previous motion of the user may need to be taken into consideration.

The moving state of the user may include, for example, a standing state, a stand-to-sit state, a sitting state and a sit-to-stand state. Also, the moving state may include a walking state.

The processor 420 may use a Finite State Machine (FSM) to set a relationship between moving states of the user, to determine a moving state of the user. A method of determining a moving state will be further described with reference to FIG. 16.

Figure 13:
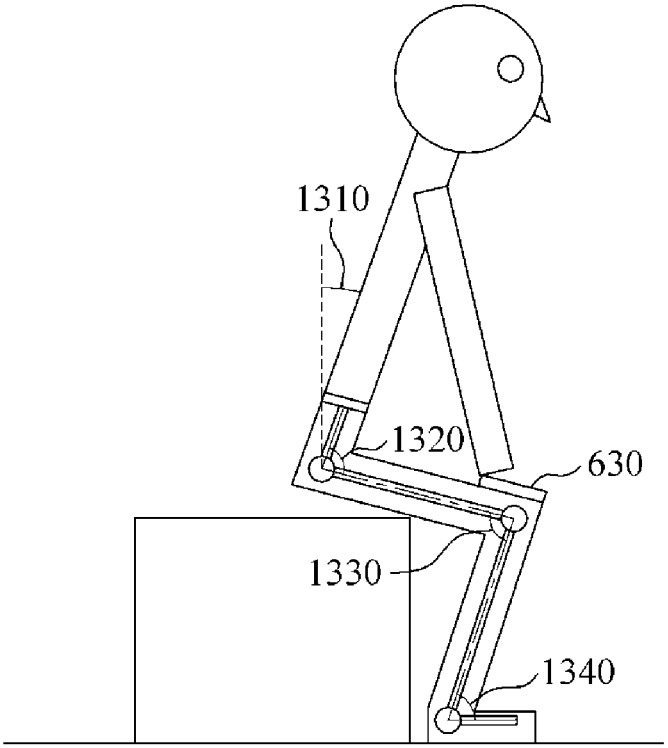
FIG. 13 illustrates joint angles of a user according to at least one example embodiment.

FIG. 13 illustrates joint angles of a user according to at least one example embodiment.

The joint angles may include, for example, the hip joint angle 1320, a knee joint angle 1330 and an ankle joint angle 1340. For example, the hip joint angle 1320 may be an angle formed by a waist support and a thigh connector. The knee joint angle 1330 and the ankle joint angle 1340 may be an angle formed by the thigh connector and a calf support, and an angle formed by a calf connector and a sole of a foot, respectively. The joint angle sensor 460 may measure left and right hip joint angles, knee joint angles and ankle joint angles.

The upper body angle 1310 between the waist support and the direction of gravity may be measured using the IMU 470. Rotation information of legs may be calculated based on the upper body angle 1310 and the hip joint angle 1320.

For example, a joint angle may be repeatedly measured at preset intervals, and may be used to repeatedly update the moving state of the user.

The pressure sensor 630 may measure pressure applied to the knees of the user.

Figure 14:
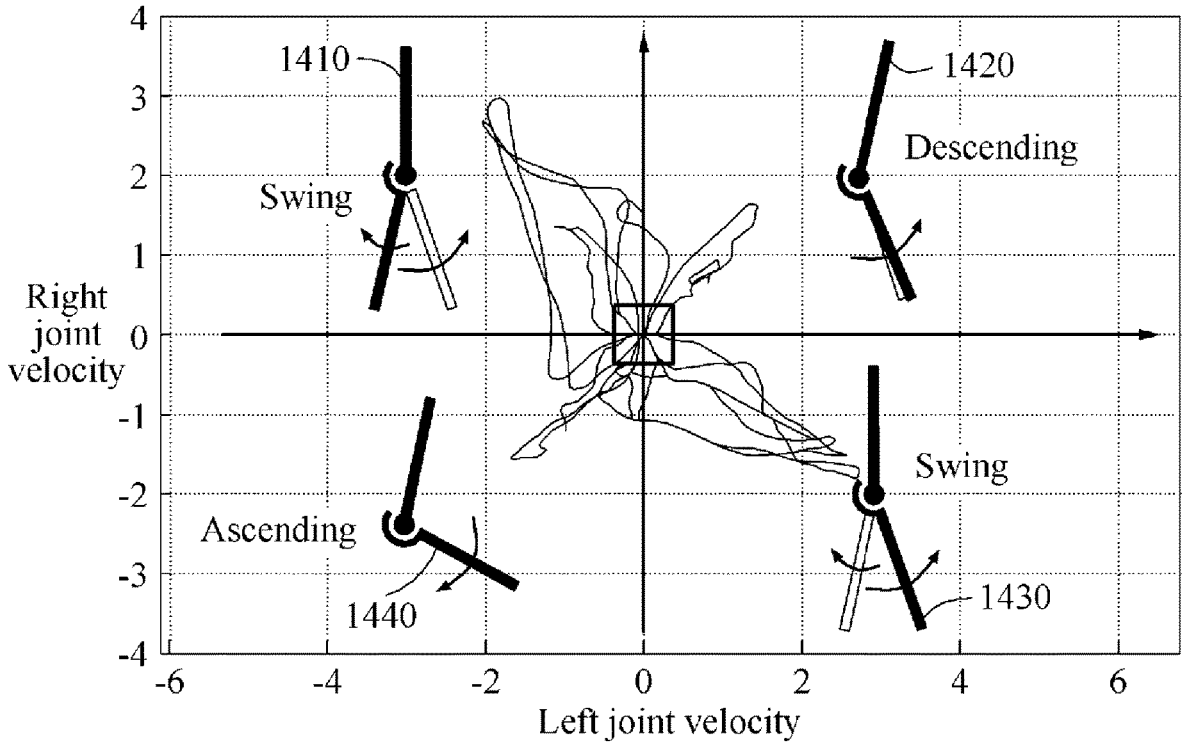
FIG. 14 is a graph showing motion events distinguished based on a right leg rotational angular velocity and a left leg rotational angular velocity of a user according to at least one example embodiment.

FIG. 14 is a graph showing motion events distinguished based on a right leg rotational angular velocity and a left leg rotational angular velocity of a user according to at least one example embodiment.

In the graph of FIG. 14, an x-axis represents a left leg rotational angular velocity, and a y-axis represents a right leg rotational angular velocity. Motion events of a user may correspond to quadrants of the graph, starting from a first quadrant in an upper right portion of the graph and proceeding counter clockwise.

In a second quadrant and a fourth quadrant of the graph, the right leg rotational angular velocity and the left leg rotational angular velocity have opposite signs, which may indicate that a right leg and a left leg of a user may move in different directions. Accordingly, the second quadrant and the fourth quadrant may correspond to swing events 1410 and 1430, respectively.

In a first quadrant and a third quadrant of the graph, the right leg rotational angular velocity and the left leg rotational angular velocity have the same sign, which may indicate that the right leg and the left leg may move in the same direction.

In the first quadrant, both the right leg rotational angular velocity and the left leg rotational angular velocity have positive values, which may indicate that both the right leg and the left leg are moving to a flexed position. For example, when both the right leg and the left leg are moved to the flexed position, a moving state of the user may correspond to a stand-to-sit motion, that is, a descending motion. The first quadrant may correspond to, for example, a descending event 1420.

Unlike the first quadrant, in the third quadrant, both the right leg rotational angular velocity and the left leg rotational angular velocity have negative values, which may indicate that both the right leg and the left leg are moving to an extended position. For example, when both the right leg and the left leg are moved to the extended position, a moving state of the user may correspond to a sit-to-stand motion, that is, an ascending motion. The third quadrant may correspond to, for example, an ascending event 1440.

As described above, the motion events may be distinguished based on characteristics of the right leg rotational angular velocity and the left leg rotational angular velocity.

In addition, a curve displayed in a central portion of the graph represents a relationship between the right leg rotational angular velocity and the left leg rotational angular velocity based on data of the right leg rotational angular velocity and data of the left leg rotational angular velocity for each of the motion events, based on the x-axis and the y-axis. Accordingly, a relationship between a right leg rotational angular velocity and a left leg rotational angular velocity calculated based on an actual user's motion event may have the same characteristic as that of the relationship shown in the graph.

A method of distinguishing motion events based on characteristics of a right leg rotational angle and left leg rotational angle of a user and of generating the distinguished motion events will be described with reference to FIG. 15.

Figure 15:
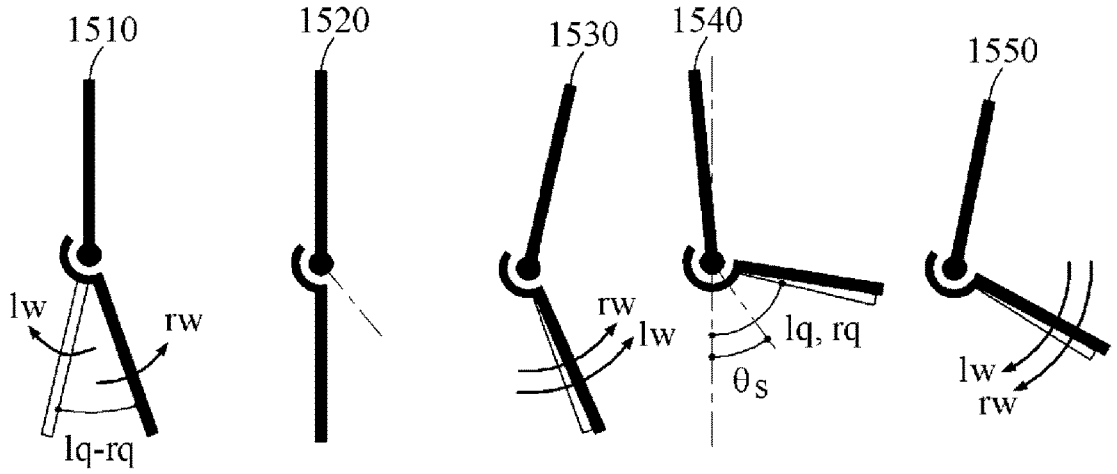
FIG. 15 illustrates models obtained by simplifying motion events according to at least one example embodiments.

FIG. 15 illustrates models obtained by simplifying motion events according to at least one example embodiments.

Referring to FIG. 15, the motion events may include a swing event 1510, an extension event 1520, a descending event 1530, a flexion event 1540 and an ascending event 1550.

The swing events 1410 and 1430, the descending event 1420 and the ascending event 1140 may correspond to events 1510, 1530 and 1550, respectively. In addition to the swing events 1410 and 1430, the ascending event 1440 and the descending event 1420 of FIG. 14, the motion events may include the extension event 1520 and the flexion event 1540 that correspond to a stop state of a user.

Table 2 shows characteristics of a right leg rotational angle and left leg rotational angle for each of motion events.

TABLE 2

| | Swing event | Extension event | Ascending event | Flexion event | Descending event |
|---|---|---|---|---|---|
| lq | . | $<\theta_s$ | . | $>\theta_s$ | . |
| rq | . | $<\theta_s$ | . | $>\theta_s$ | . |
| lq-rq | . | ≈0 | ≈0 | ≈0 | ≈0 |
| lw | +− | ≈0 | − | ≈0 | + |
| rw | −+ | ≈0 | − | ≈0 | + |
| Duration | $>t_{swg}$ | $>t_{ext}$ | $>t_{asc}$ | $>t_{flx}$ | $>t_{dsc}$ |

The swing event 1510 refers to an event in which legs cross, such as when a user is ambulatory. In the swing event 1510, a direction of a right leg rotational angular velocity rw may be opposite to a direction of a left leg rotational angular velocity lw. When a right leg rotational angular velocity and a left leg rotational angular velocity have opposite signs, a motion event may be determined as the swing event 1510.

In the extension event 1520, each of the right leg rotational angular velocity rw and the left leg rotational angular velocity lw may have a value close to "0." In the extension event 1520, both a left leg and a right leg may be extended so that both a left leg rotational angle lq and a right leg rotational angle rq may be less than a desired (or, alternatively, predetermined) angle θs. Also, a difference lq-rq between the left leg rotational angle lq and the right leg rotational angle rq may be close to "0."

In the descending event 1530, the right leg rotational angular velocity rw and the left leg rotational angular velocity lw may have positive values, and the difference lq-rq may be close to "0."

In the flexion event 1540, each of the right leg rotational angular velocity rw and the left leg rotational angular velocity lw may have a value close to "0," and both the left leg and the right leg may be bent so that both the left leg rotational angle lq and the right leg rotational angle rq may be greater than the angle θs. Additionally, the difference between left leg rotational angle and the right leg rotational angle lq-rq may be close to "0."

In the ascending event 1550, the right leg rotational angular velocity rw and the left leg rotational angular velocity lw may have negative values, and the difference between left leg rotational angle and the right leg rotational angle lq-rq may be close to "0."

To generate each of the motion events, a condition for each of the motion events may need to be maintained for longer than a duration set for each of the motion events. Accordingly, during a duration, it is possible to filter out measured noise or an uncertain movement, for example, a small movement, of the user. Also, by setting a duration, it is possible to prevent a change in a moving state of a user from being unnecessarily, frequently sensed. Thus, it is possible to acquire a reliable result.

The processor 420 may verify a duration of a corresponding motion event. When the duration is equal to or longer than a set (or, alternatively, a preset) period of time, the corresponding motion event may be finally generated.

As described above, motion events may be classified based on rotation information of legs. For example, the motion events may be distinguished as shown in Table 3, based on a combination of mapped context information.

TABLE 3

| | LA | RA | LSA | RSA | DA | LW | RW | Duration |
|---|---|---|---|---|---|---|---|---|
| Descending event | 1 | 1 | • | • | 0 | 1 | 1 | >20 ms |
| Ascending event | 1 | 1 | • | • | 0 | −1 | −1 | >20 ms |
| Flexion event | • | • | −1 | −1 | 0 | 0 | 0 | >50 ms |
| Extension event | • | • | 1 | 1 | 0 | 0 | 0 | >50 ms |
| Swing event | • | • | • | • | • | 1 | −1 | >20 ms |
| | • | • | • | • | • | −1 | 1 | |

Table 3 shows conditions that context information corresponds to each of motion events, based on a characteristic of right and left rotation information for each of the motion events.

The processor 420 may generate motion events corresponding to context information mapped based on conditions of Table 3. The generated motion events may be used to determine a current moving state of a user.

Figure 16:
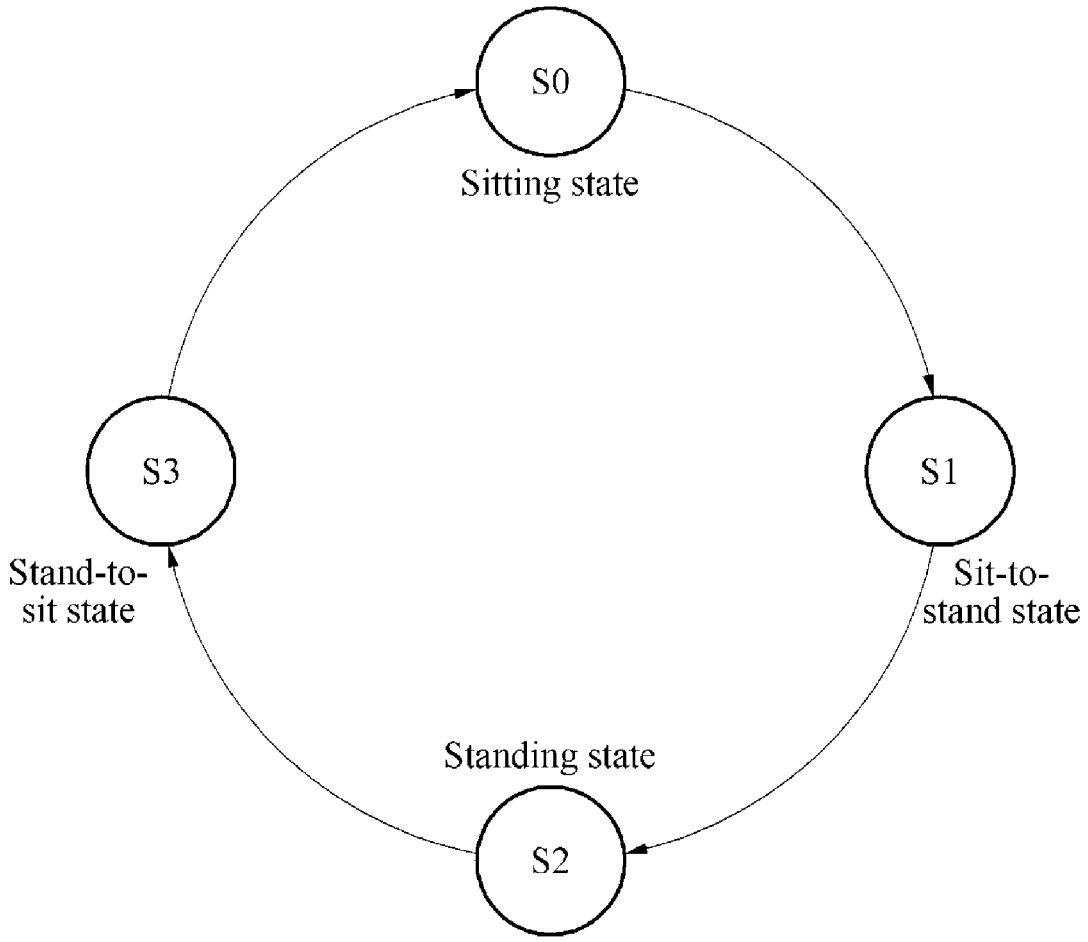
FIG. 16 illustrates a transition between a plurality of moving states according to at least one example embodiment.

FIG. 16 illustrates a transition between a plurality of moving states according to at least one example embodiment.

Referring to FIGS. 12 and 16, when performing operation 1240, the processor 420 may determine a current moving state of a user based on a generated motion event and a previous moving state of the user.

The processor 420 may determine a moving state corresponding to estimated rotation information among a plurality of preset moving states. For example, the processor 420 may determine the moving state based on a motion event generated based on the estimated rotation information.

A current moving state of a user may be recognized differently based on a previous moving state of the user, despite an occurrence of the same motion events, and accordingly a previous motion of the user may need to be taken into consideration.

The moving state of the user may include, for example, a standing state, a stand-to-sit state, a sitting state and a sit-to-stand state. Also, the moving state may include a walking state, although not shown in FIG. 16.

The processor 420 may use a Finite State Machine (FSM) that is set based on a relationship between moving states of the user, to distinguish the moving states.

The FSM may include a plurality of moving states distinguished based on the moving state of the user. The plurality of moving states may include, for example, a sitting state S0, a sit-to-stand state S1, a standing state S2 and a stand-to-sit state S3.

A motion event may be set as a transition condition between the plurality of moving states. Moving states of the user may be consecutive states as described above, and may transition to each other in response to generation of a predetermined motion event.

In an example, when a previous moving state of a user is the sit-to-stand state S1, and when an extension event is generated as a motion event, a current moving state of the user may be determined as the standing state S2.

In another example, when the previous moving state is the standing state S2, and when a descending event is generated as a motion event, the current moving state may be determined as the stand-to-sit state S3.

In still another example, when the previous moving state is the stand-to-sit state S3, and when a flexion event is generated as a motion event, the current moving state may be determined as the sitting state S0.

In yet another example, when the previous moving state is the sitting state S0, and when an ascending event is generated as a motion event, the current moving state may be determined as the sit-to-stand state S1.

The processor 420 may determine a current moving state of a user based on a previous moving state of the user and a generated motion event.

The above-described FSM is merely an example for understanding of description, and there is no limitation thereto. Accordingly, it is obvious to one of ordinary skill in the art that different moving states of a user and different transition conditions may be set based on a relationship between the moving states.

The units and/or modules described herein may be implemented using hardware components, software components, or a combination thereof. For example, the hardware components may include microphones, amplifiers, band-pass filters, audio to digital convertors, and processing devices. A processing device may be implemented using one or more hardware device configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A standing-up assistance method performed by a standing-up assistance apparatus comprising:

measuring, via at least one sensor of the standing-up assistance apparatus, a magnitude of a pressure applied to a part of a body of a user by one or more hands of the user;

acquiring, by a processor of the standing-up assistance apparatus, a value of torque corresponding to the magnitude of the pressure; and outputting, by at least one motor of the standing-up assistance apparatus, the torque based on the value of the torque for assisting a standing-up of the user, wherein the outputting includes outputting, via the at least one motor, the torque based on the value of the torque such that, when the magnitude of the pressure is less than a set threshold, a magnitude of the torque increases when the pressure increases, and when the magnitude of the pressure is greater than or equal to the set threshold, the magnitude of the torque is set to a preset maximum.

2. The standing-up assistance method of claim 1, wherein the measuring comprises:

measuring the pressure applied to a knee of the user.

3. The standing-up assistance method of claim 1, further comprising:

determining a moving state of the user, wherein the value of the torque is acquired, if the determining determines that the moving state is a sit-to-stand state.

4. The standing-up assistance method of claim 3, wherein the determining the moving state comprises:

measuring at least one joint angle of the user; and determining the moving state based on the at least one joint angle.

5. The standing-up assistance method of claim 4, wherein the at least one joint angle includes one or more of a left hip joint angle and a right hip joint angle of the user.

6. The standing-up assistance method of claim 4, wherein the at least one joint angle includes one or more of a left knee joint angle and a right knee joint angle of the user.

7. The standing-up assistance method of claim 4, wherein the at least one joint angle includes one or more of a left ankle joint angle and a right ankle joint angle of the user.

8. The standing-up assistance method of claim 3, wherein the determining of the moving state comprises:

sensing an upper body movement associated with movement of an upper part of the body of the user; and determining the moving state based on the upper body movement.

9. The standing-up assistance method of claim 8, wherein the sensing comprises:

sensing the upper body movement using an inertial measurement unit (IMU).

10. The standing-up assistance method of claim 3, wherein the determining of the moving state comprises:

measuring at least one joint angle of the user;

sensing an upper body movement associated with movement of an upper part of the body of the user;

estimating rotation information of one or more legs of the user based on the at least one joint angle and the upper body movement; and determining the moving state based on the rotation information.

11. The standing-up assistance method of claim 10, wherein the determining the moving state comprises:

determining which of a plurality of moving states corresponds to the rotation information.

12. The standing-up assistance method of claim 11, wherein the plurality of moving states includes at least a standing state, a sitting state, the sit-to-stand state and a stand-to-sit state.

13. The standing-up assistance method of claim 10 wherein the determining the moving state comprises:

determining which of a plurality of moving states corresponds to the at least one joint angle of the user.

14. The standing-up assistance method of claim 1, further comprising:

storing a torque pattern associated with the value of the torque; and generating a sit-to-stand pattern of the user based on the torque pattern.

15. The standing-up assistance method of claim 14, further comprising:

determining a moving state of the user, wherein the force torque is output if the determining determines that the moving state is a sit-to-stand state, and the outputting the torque includes, setting a second value of torque corresponding to the sit-to-stand pattern, when the sit-to-stand pattern is generated; and outputting a torque based on the second value of the torque.

16. The standing-up assistance method of claim 14, wherein the generating the sit-to-stand pattern comprises:

adjusting the sit-to-stand pattern based on one or more additional torque patterns associated with the sit-to-stand pattern.

17. The method of claim 1, wherein the acquiring comprises:

calculating the value of the torque such that the value of the torque is proportional to the magnitude of the pressure based on a preset constant.

18. A standing-up assistance apparatus comprising:

a pressure sensor configured to measure a magnitude of pressure applied to a part of a body of a user by one or more hands of the user;

a processor configured to acquire a value of torque corresponding to the magnitude of the pressure; and a driver configured to output the torque based on the value of the torque for assisting a standing-up of the user, the driver configured to output the torque based on the value of the torque such that, when the magnitude of the pressure is less than a set threshold, a magnitude of the torque increases when the pressure increases, and when the magnitude of the pressure is greater than or equal to the set threshold, the magnitude of the torque is set to a preset maximum.

19. The standing-up assistance apparatus of claim 18, wherein the pressure sensor is configured to measure a pressure applied to a knee of the user by the one or more hands of the user.

20. The standing-up assistance apparatus of claim 18, wherein the processor is configured to, determine a moving state of the user, and acquire the value of the torque, if the processor determines that the moving state is a sit-to-stand state.

21. The standing-up assistance apparatus of claim 20, further comprising:

an inertial measurement unit (IMU) configured to sense an upper body movement associated with movement of an upper part of the body of the user, wherein the processor is configured to determine the moving state based on the upper body movement.

22. The standing-up assistance apparatus of claim 20, further comprising:

at least one joint angle sensor configured to measure at least one joint angle of the user; and an inertial measurement unit (IMU) configured to sense an upper body movement associated with movement of an upper part of the body of the user, wherein the processor is configured to, estimate rotation information of one or more legs of the user based on the at least one joint angle and the upper body movement, and determine the moving state based on the rotation information.

23. The standing-up assistance apparatus of claim 18, further comprising:

a memory configured to store a torque pattern associated with the value of the torque, wherein the processor is configured to generate a sit-to-stand pattern of the user based on the torque pattern.

24. The standing-up assistance apparatus of claim 23, wherein the processor is configured to, determine a moving state of the user, set a second value of torque corresponding to the sit-to-stand pattern, if the moving state is a sit-to-stand state and the sit-to-stand pattern is generated, and instruct the driver to output a torque to the body of the user based on the second value of the torque.

25. A method of generating an assistance force to assist a user to stand-up using an assistance device, the method comprising:

measuring, via at least one sensor of the assistance device, a magnitude of pressure applied to one or more of knees of the user by one or more hands of the user;

determining if a moving state of the user is a sit-to-stand state;

acquiring, by a processor of the assistance device, a value of torque corresponding to the magnitude of the pressure, if the moving state is the sit-to-stand state; and outputting, via at least one motor of the assistance device, the torque based on the value of the torque, wherein the outputting includes outputting, via the at least one motor, the torque based on the value of the torque such that, when the magnitude of the pressure is less than a set threshold, a magnitude of the torque increases when the pressure increases, and when the magnitude of the pressure is greater than or equal to the set threshold, the magnitude of the torque is set to a preset maximum.

26. The method of claim 25, wherein the determining comprises:

calculating rotation information associated with rotation of one or more legs of the user.

27. The method of claim 26, wherein the calculating rotation information includes measuring one or more of a joint angle of a joint of a lower body of the user and motion of an upper body of the user.

28. The method of claim 27, wherein the measuring comprises:

measuring one or more of an angular velocity and acceleration of the upper body of the user.

* * * * *